US006053624A

United States Patent [19]

Cronk

[11] Patent Number: 6,053,624

[45] Date of Patent: Apr. 25, 2000

[54] LAMP REFLECTOR WITH ADJUSTABLE CURVATURE

[76] Inventor: Paul Andrew Cronk, Unit 1, 65 Evans Street, Harbord, NSW 2096, Australia

[21] Appl. No.: 08/952,628

[22] PCT Filed: May 24, 1995

[86] PCT No.: PCT/AU95/00303

§ 371 Date: Mar. 10, 1998

§ 102(e) Date: Mar. 10, 1998

[87] PCT Pub. No.: WO96/37732

PCT Pub. Date: Nov. 28, 1996

[51] Int. Cl.[7] ..... F21V 7/00

[52] U.S. Cl. ..... 362/347; 362/320; 362/346; 362/297

[58] Field of Search ..... 362/319, 320, 362/322, 324, 345, 346, 347, 297

[56] References Cited

U.S. PATENT DOCUMENTS

| | | | |
|---|---|---|---|
| 3,099,403 | 7/1963 | Strawick | 240/47 |
| 4,174,533 | 11/1979 | Barthes et al. | 362/346 |
| 4,796,168 | 1/1989 | Peterson | 362/297 X |
| 5,249,110 | 9/1993 | Russello et al. | 362/345 X |
| 5,570,947 | 11/1996 | Felland | 362/148 |
| 5,615,943 | 4/1997 | Coldren | 362/319 X |

FOREIGN PATENT DOCUMENTS

| | | |
|---|---|---|
| 2314935 | 10/1974 | Germany . |
| 353170 | 7/1931 | United Kingdom . |
| 2232476 | 12/1990 | United Kingdom . |

*Primary Examiner*—Laura K. Tso
*Attorney, Agent, or Firm*—Cesari and McKenna, LLP

[57] ABSTRACT

An adjustable reflector device is disclosed. The device consists of an adjustable double parabolic reflective skin (1,2) with an adjustable lamp mount (12), incorporating a V-shaped perforated heat shield (17), attached. The two part reflective skin (1,2) forms a double parabolic shape when flexed back against a reinforced spine (3). This flexible shape is secured by lengthwise adjustable chain retainers (4) attached at both ends of the skin (1,2). The lamp mount (12) slides onto a pair of threaded bolts (6,7) secured to the skin and adjustment is achieved by tightening or loosening the appropriate nuts (15,16). The heat shield (17) slides onto the lamp fitting (18) and is positioned appropriately to deflect incident heat and light. This device can be used to provide variable conditions of artificial illumination.

14 Claims, 2 Drawing Sheets

LAMP REFLECTOR WITH ADJUSTABLE CURVATURE

BACKGROUND OF THE INVENTION

This invention relates to improvements in devices for reflecting light emitted by artificial sources.

DESCRIPTION OF THE PRIOR ART

Moderm industries requirements for artificial lighting are extensive, varied, and constantly expanding.

Many types of reflector devices associated with artificial illumination of industrial spaces are currently known, but these all require that a fixed shape and/or a fixed lamp mounting position within that shape be precisely specified to create optimal light distribution for a particular purpose. For example, a 'chinaman hat' reflector might commonly be used in a situation where a wide, uniform spread of light is required. In this case, the spreading of light is largely dependant on the fixed internal angle of the cone shaped 'chinaman hat' reflector. The uniformity of light emitted is therefore largely dependant on the non-adjustable lamp positioning within that reflector. These known devices have the disadvantage that their rigid, non-adjustable, designs limit their efficient use to a relatively small range of applications.

SUMMARY OF THE INVENTION

The present invention seeks to provide an adjustable heat reflecting device which overcomes the disadvantages of the prior art.

In one broad form, the present invention provides a reflector device, comprising a pair of resilient sheet members, which are normally disposed at a substantially orthogonal angle relative to each other, and which are adapted to be flexed and retained against the bias of their normal resilience such that said device is formed to a curved, and preferably double parabolic (as herein defined), shape.

Preferably, said sheet members are retained in said curved or double parabolic shape by a retaining means linked between said sheet members at substantially edge portions thereof.

Also preferably, said retaining means is a chain, or wire or like means, optionally adjustable in length.

In a preferred form, lighting means is adapted to be attached to said device when in the retained position, by an optionally adjustable attachment means.

In a preferred embodiment a heat shield is provided about at least part of said lighting means.

Preferably, said heat shield is V-shaped and secured to the underside of said lighting means.

In a preferred form, each of said sheets members are separately fabricated and then secured together to form said device.

Preferably, each of said sheet members are substantially rectangularly shaped and provided with a substantially orthogonally protruding skirt adjacent an edge of the respective sheet, whereby, to form said device, the skirt of a first sheet is connected to the edge of said second sheet, and the skirt of said second sheet is connected to the edge of said first sheet.

Also preferably, said skirts and said edges are connected by bolts, welds or the like.

BRIEF DESCRIPTION OF THE DRAWINGS

The present invention will become more fully understood from the following description of a preferred but non-limiting embodiment thereof, described in connection with the accompanying drawings, wherein.

DETAILED DESCRIPTION OF THE PREFERRED EMBODIMENTS(S)

Throughout the drawings, like numerals will be utilized to represent similar features, except where expressly otherwise indicated.

Figure 1:
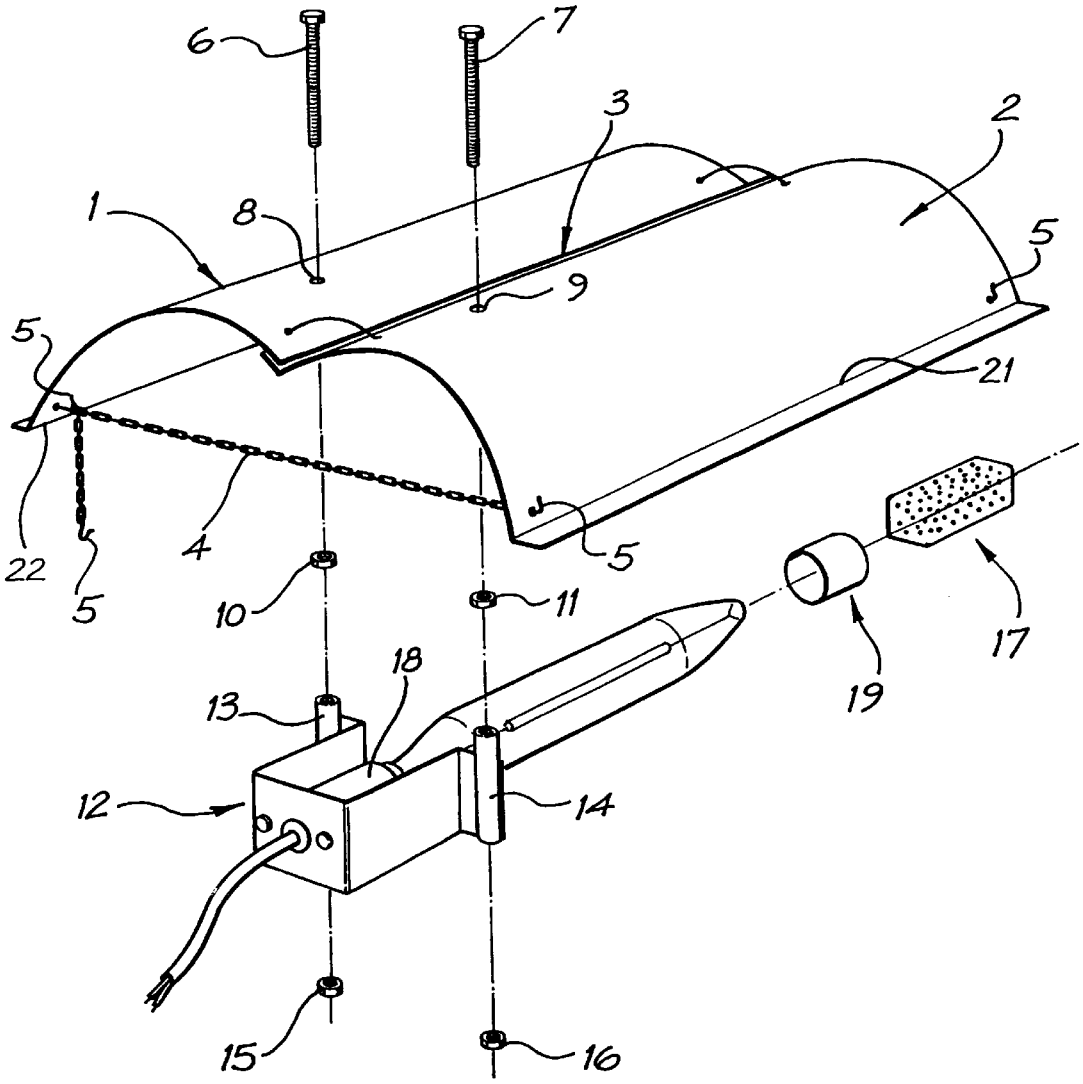
FIG. 1 shows an exploded view of one example of an adjustable reflector device according to the present invention.

Also, throughout the specification, the term "a double parabolic" is utilised to describe the shape of the device when it is in its flexed position, and retained against the bias of it's normal resilience, as for example, shown in FIG. 1 of the drawings. In considering this definition, it should be appreciated that any size, shape or width of double parabolic or similar shape should be considered to fall within the scope of this definition.

The present invention provides an adjustable light reflector device comprising a resilient reflective skin, flexed to form a double parabolic shape, which is held in place against its resiliency by adjustable retainers located at each end of the skin and an independently adjustable lamp mount which attaches to the skin when it is in the retained position. A slide on V-shaped perforated heat shield is preferably attached to the lamp fitting.

Referring to FIG. 1 it can be seen that the adjustable reflector device according to this invention comprises a two piece resilient skin formed by two members 1 and 2, comprised of a substantially orthogonally protruding skirt parallel with the longest edge thereof. The sheet members are substantially rectangularly shaped sheet, detachably joined about a spine portion 3 then flexed back against its normal resilience to produce a double parabolic shape, as shown, such that one edge and associated skirt of one sheet member fits neatly inside the corresponding skirt and edge of the other, forming substantially orthogonal alignment between sheets. The sheets are then fixed together and flexed back to achieve a curved shape, such as a double-parabolic shape. The skin may be made of any suitable material such as colour bonded metal, metal, fibreglass, or plastic. The pair of sheet members could be integrally manufactured in a one piece construction—as opposed to being separately formed. These sheets are adjustably secured by a pair of chain 4 and hook 5 retainers (only one retainer shown because of orientation). The retaining means may be a chain, wire or like means, optionally adjustable in length. A pair of threaded bolts 6 and 7 pass down through holes 8 and 9 in the top of the assembled skin and are secured by nuts 10 and 11.

A lamp mount 12 attaches to bolts 6 and 7 through holes 13 and 14 and is adjustably secured by attaching nuts 15 and 16. The lamp mount comprises a sliding plate that adjusts along a pair of threaded bolts which pass through holes in the skin. Nuts are used to secure bolts to the skin and to provide a means of adjustment for the sliding plate. The luminair mount may be designed in any fashion, adjustable or non-adjustable, so long as it does not substantially inhibit flexibility of the skin when attached thereto.

A V-shaped perforated heat shield 17 slides onto the lamp fitting 18 and is secured to the underside thereof by a grub screw 19. The heat shield is preferably provided about at least part of the element or filament portion of the lighting means, and is attached via a slender arm, to a piece of cylindrical tube which slides onto the lamp fitting and is secured with a grub screw. The heat shield may be perforated with any number of holes of any size or shape so long as it is substantially V-shaped. It may attach to the lamp fitting by any method capable of securing the shield parallel to the under side of the lamp. Folds at 20 and 21 produce rigidity and strength in the flexed and retained skin. The resilient reflective skin may comprise one or any number of sheet members and any necessary reinforcing members fashioned so as to approximate the predefined shape and conditions required for formation of a flexible double parabolic shape as herein defined.

Figure 2:
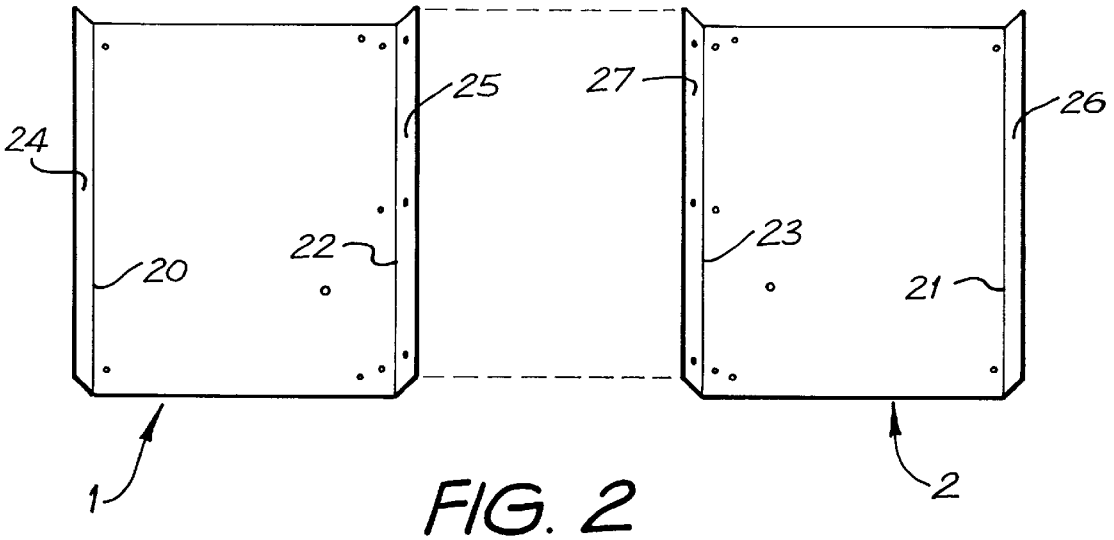
FIG. 2 shows a disassembled view of the skin of the reflector device, depicting the substantially orthogonally protruding skirts, present on sheet members; and, FIG. 3 shows an assembled view of the skin prior to flexing, depicting the substantially orthogonal alignment of sheet members.

Referring to FIG. 2 it can be seen that sheet members 1 and 2 which comprise the skin, each have two folds 20, 22 and 21, 23 which create associated skirts 24, 25 and 26, 27.

Figure 3:
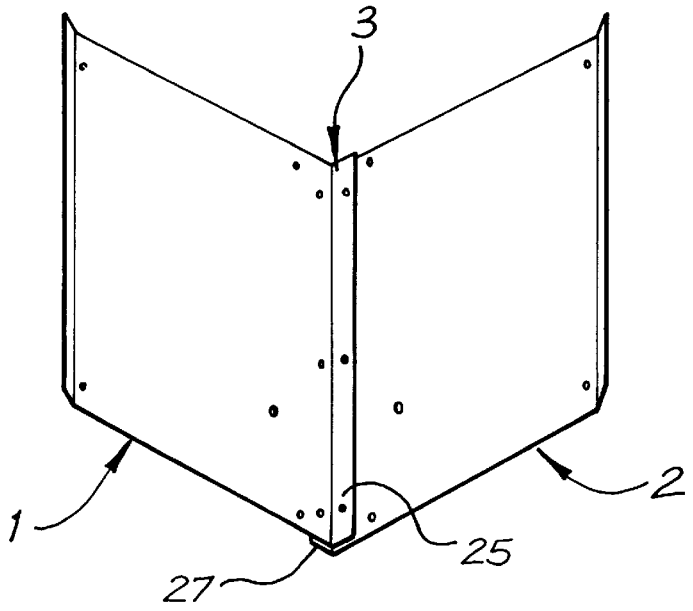

Referring to FIG. 3 it can be seen how sheet members 1 and 2 are joined at a substantially orthogonal angle. Skirts 27 and 25 attached to the bodies of sheet members 1 and 2 to create a reinforced joint about the newly created spine 3.

By appropriate adjustment of the reflective device described above, many and varied desirable conditions of artificial illumination may be achieved. Hence the need to employ more than one reflective device to efficiently service a range of discrete tasks may be reduced or abolished.

It will be realized that the reflector device according to this invention is not restricted to the specific shape and construction of the resilient skin shown in the example, but may use a skin fashioned from one, two, or more pieces of suitable material of any suitable shape or size so long as the essential feature of being flexed back against a spine or axial crease to create an adjustable double parabolic shape or other similar shape is achieved.

It will be understood to persons skilled in the art that variations and modifications to the invention will become possible. All such variations and modifications should be considered to fall within the scope of the invention as hereinbefore described and as hereinafter claimed.

What is claimed is:

1. A lamp reflector with adjustable curvature comprising a pair of resilient sheet members each having a reflective surface;

connecting means for connecting said sheet members together along a common spine so that the sheet members have unflexed positions wherein said reflective surfaces are transverse to each other, each sheet member being adapted to be flexed from said unflexed position to a fully flexed position which forms the corresponding reflective surface into an inside curve with maximum curvature, and adjustable retaining means connected to said sheet members for retaining said sheet members at a plurality of a selected flexed positions between said unflexed and fully flexed positions.

2. The reflector defined in claim 1 wherein the retaining means retain the sheet members so that the reflective surfaces thereof are both parabolic whereby the reflector has a double parabolic shape.

3. The reflector defined in claim 1 wherein each sheet member has an outside edge opposite said spine, and the retaining means comprise at least one link linking said outside edges.

4. The reflector defined in claim 3 wherein said link is adjustable in length.

5. The reflector defined in claim 1 or 2 and further including lighting means, and attachment means adjustably attaching said lighting means to said sheet members adjacent to said spine.

6. The reflector defined in claim 5 and further including a heat shield disposed about at least part of the lighting means.

7. The reflector defined in claim 6 wherein the heat shield is a slide-on, V-shaped, perforated adjustable heat shield.

8. The reflector defined in claim 6 wherein the lighting means include a lamp socket, and the heat shield is attached to said attachment means or to the lamp socket.

9. The reflector defined in claim 6 wherein the heat shield is positioned on the opposite side of the lighting means from said sheet members.

10. The reflector defined in claim 1 or 2 wherein said connecting means comprise a boundary between said sheet members along said spine, said sheet members and said boundary being fabricated integrally from a single sheet of material.

11. The reflector defined in claim 1 or 2 wherein each of said sheet members is fabricated separately, and said connecting means include fastener means fastening said sheet members together along said spine.

12. The reflector defined in claim 11 wherein each of the sheet members is substantially rectangular and has a transverse protruding skirt extending along said spine, and said fastener means connect the skirt of one of the sheet members to the other of the sheet members, and vice versa.

13. The reflector defined in claim 12 wherein the fastener means are threaded fasteners or welds.

14. A lamp reflector with adjustable curvature comprising a pair of resilient sheet members, said sheet members having reflective surfaces and being connected so that, when in an unstressed condition, said sheet members are disposed at an angle relative to each other, and when flexed away from said angle, the reflective surface of each sheet member assumes a parabolic shape and means connected to said sheet member for adjustable flexing said members away from said angle.

* * * * *